United States Patent [19]

Anthony

[11] Patent Number: 4,529,258

[45] Date of Patent: Jul. 16, 1985

[54] ELECTRIC LAMP SOCKET ASSEMBLY HAVING STRIPLESS WIRING TERMINALS

[75] Inventor: Walter H. Anthony, Pine Beach, N.J.

[73] Assignee: Challenger Circle F Inc., Trenton, N.J.

[21] Appl. No.: 471,406

[22] Filed: Mar. 2, 1983

[51] Int. Cl.[3] ..... H01R 11/20

[52] U.S. Cl. ..... 339/99 L; 339/176 L; 339/180; 339/97 L

[58] Field of Search ..... 339/97 R, 97 L, 99 R, 339/99 L, 176 L, 177 L, 178, 180, 182 L, 184 L, 185 RL, 189 L, 191 L, 192 RL

[56] References Cited

U.S. PATENT DOCUMENTS

| | | | |
|---|---|---|---|
| 1,285,361 | 11/1918 | Pettibone | 339/99 L |
| 2,728,059 | 12/1955 | Lagin | 339/97 |
| 2,751,568 | 6/1956 | Despard | 339/180 |
| 3,151,926 | 10/1964 | Schick et al. | 339/99 |
| 3,397,379 | 8/1968 | Puig | 339/99 |
| 4,283,107 | 8/1981 | Anthony | 339/97 L |

*Primary Examiner*—Gil Weidenfeld
*Assistant Examiner*—Paula Austin
*Attorney, Agent, or Firm*—Sperry, Zoda & Kane

[57] ABSTRACT

A lamp socket assembly includes stripless wiring terminals which minimize wiring time while providing strain relief. A hinged cover guides and aligns an electric cord to the terminals and provides clamping action.

12 Claims, 8 Drawing Figures

FIG. 4
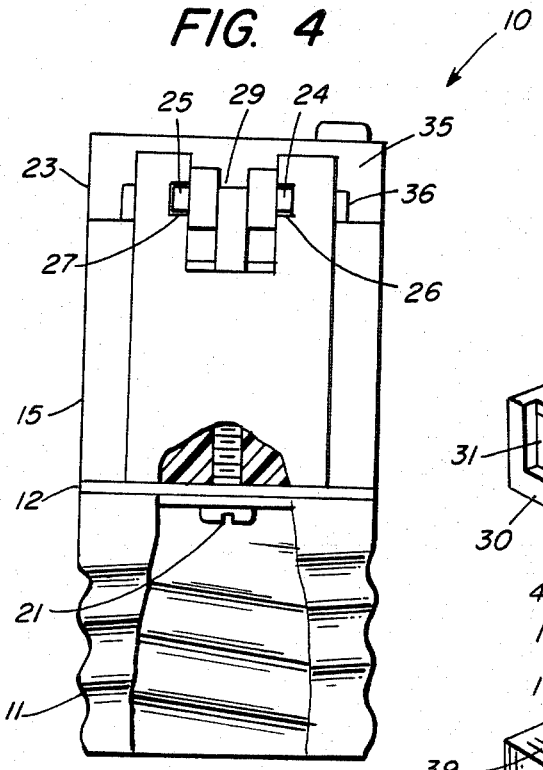
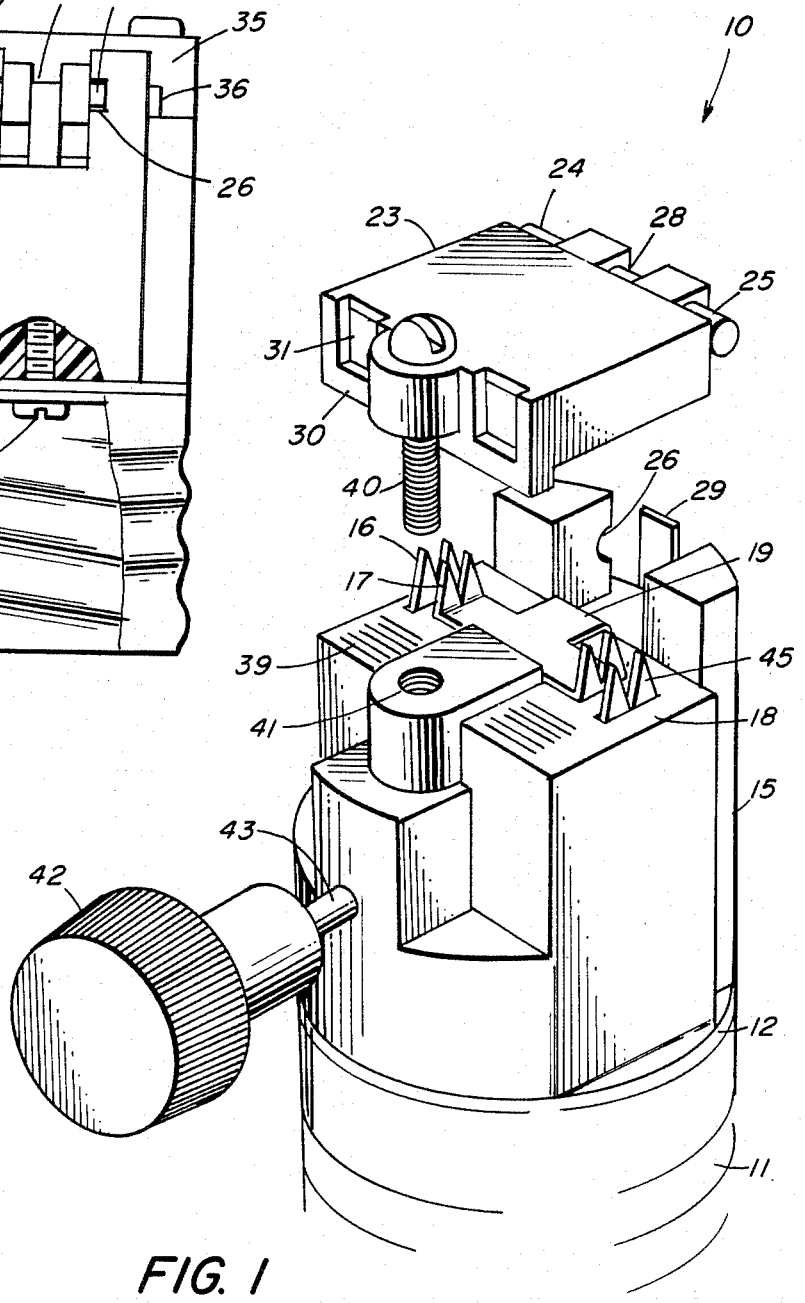
FIG. 1

ELECTRIC LAMP SOCKET ASSEMBLY HAVING STRIPLESS WIRING TERMINALS

RELATED PATENTS

U.S. Pat. No. 4,283,107 for "Lampholder Having Terminals of the Insulation-Displaying Type" issued to Walter Anthony is hereby incorporated by reference.

BACKGROUND OF THE INVENTION

This invention pertains to electric lamp sockets and, more particularly, is concerned with lamp sockets having stripless wiring terminals.

Portable lighting units, which include desk lamps, floor lamps, and the like, use a lamp socket assembly usually enclosed in either a paper sleeve or a metal shell. The socket assembly is also called a "lampholder" or an "interior".

During manufacture of the lighting unit an electric cord set must be electrically connected to the socket assembly. In the past this has usually been accomplished by use of screw terminals.

Underwriter's Laboratories (UL) Standards applicable for portable lamp screw terminals call for the end of stripped wires to be either tin dipped or otherwise restrained to prevent unraveling of the wire strands. Alternately, the wires may be soldered to the terminals. Either method requires semi-skilled labor and takes longer than desired, thereby increasing the cost of the assembled lamp. This problem has long been recognized as evidenced by a number of patents directed to electric lamp sockets having stripless terminals. Stripless terminals may be broadly grouped as being of the insulation piercing type of the insulation displacing type.

Examples of patents dealing with the insulation piercing type are U.S. Pat. Nos. 2,728,059; 3,397,379; and 3,151,926. U.S. Pat. No. 2,728,059 issued to Lagin discloses an electric lamp socket with two insulation piecing terminals extending from a socket body. A separate snap-on cover covers the terminals. One of the terminals is connected to the screwshell while the other is connected to a switch contact within the body. The terminals are spaced so that the electric wires must be separated from each other. There is no provision to assure that the neutral wire is connected to the screwshell.

U.S. Pat. No. 3,397,379 issued to Puig calls for wires to be fed through separate passages in a threaded body to be proximate insulation piercing terminals. A separate sleeve with a mating thread is screwed onto the body and presses the wires against the terminals.

U.S. Pat. No. 3,151,926 issued to Schick et al. describes a lamp socket of the type intended to be placed in parallel along the length of an electric cord (e.g., Christmas lights). The socket body has a channel into which an electric cord is placed. Terminals within the channel pierce the cord's insulation. A separate wedge piece is clipped to the body to hold the cord in the channel and to provide strain relief.

The sockets described above are not one piece assemblies and, furthermore, do not appear adaptable for use in standard paper or metal shells.

The aforeincorporated U.S. Pat. No. 4,283,107 issued to the present applicant divulges a one-piece socket assembly having terminals of the insulation displacing type eliminating the need to strip insulation from the cord set.

SUMMARY OF THE INVENTION

In one aspect of the invention, there is provided an electrical lamp socket assembly which includes insulation piercing terminals protruding from the end of a body. A cover is pivotably mounted on the body and can close over the terminal. The cover includes means to hold an electric cord and align it with the terminals. When the cover is closed, it clamps the cord against the socket body. In another aspect of the invention, the body may include ridges to increase the grip on the cord.

BRIEF DESCRIPTION OF THE DRAWING

In the drawings:

FIG. 1 is a pictorial view of an electric lamp socket according to the invention;

FIG. 4 is a rear view of the assembly with parts of the screwshell or body cutaway;

For a better understanding of the present invention, together with other and further objects, advantages and capabilities thereof, reference is made to the following disclosure and appended claims in connection with the above-described drawings.

DESCRIPTION OF THE INVENTION

FIG. 1 illustrates an embodiment of the present invention in the form of a socket assembly 10. The socket assembly is illustrated as including a rotary knob type switch although the invention is not so limited. The socket assembly may include a switch or be without a switch, known in the trade as "keyless". The type of switch, if any, is not important to the invention. Suitable switches include the rotary knob type, the push-through type, and the pull-chain type.

Figures 2, 3:
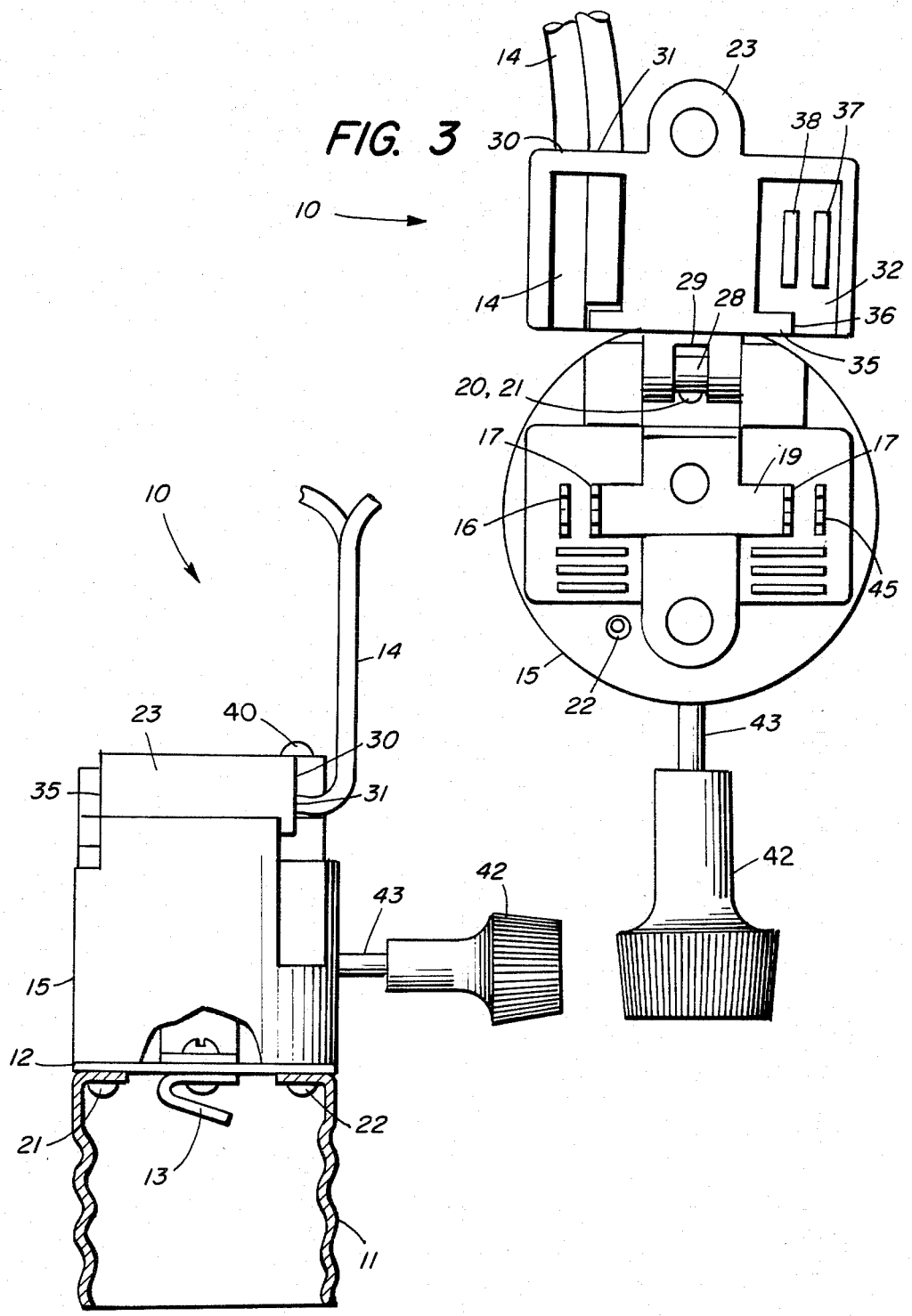
FIG. 2 is a side view of the assembly with part of the screwshell or body cutaway.
FIG. 3 is a view of the terminal end of the socket assembly.

The socket assembly 10 includes the usual screwshell 11 for receiving and holding a threaded lamp bulb base. According to industry standards, the screwshell is to be connected to electrical neutral. In FIG. 2 the screwshell 11 is shown cutaway. At the bottom of the socket defined by the screwshell 11 is an insulating disc 12 supporting a central inner socket contact 13 for making electrical connection to a corresponding contact in the lamp base. The inner socket contact is energized when it is connected to the "hot" wire of an electric cord 14.

Beneath the screwshell is an insulated body 15 preferably made of a thermoset or a thermoplastic material.

As seen in FIG. 1 and FIG. 3, at least one pair of insulation piercing terminals 16, 17 (or 17, 45) is provided at the terminal end 18 of the body 15. Each terminal includes one or more sharp metal projections extending from the end of the body. In the embodiment illustrated, two slightly offset projections are used for each terminal. The two terminals in a pair are separated by a distance about equal to the distance between the centerlines of wires in a cord set.

One terminal 45 extends into the body and is switchably connected to one or more of the aforesaid inner socket contacts if a switch is provided. This terminal 45 is to be connected to the "hot" wire of an electric cord set and accordingly referred to as the "hot" terminal. Terminal 16 is also referred to as a "hot" terminal.

Another terminal 17 is electrically connected to screwshell 11. This terminal 17 is to be connected to the neutral wire of the cord and is called the "neutral terminal." One feature of the invention is that the neutral terminal is formed from a metal neutral piece 19. The neutral piece 19 may have a tapped hole 20 for receiving a conductive fastener 21 (e.g., screw) from the screwshell 11. The screwshell 11 may, in addition, be fastened to the body by an eyelet 22 or other fastener.

As another feature of the invention, a cover 23 is arranged on the body to be closable over the terminals. In FIG. 1, the cover 23 is depicted separate from body 15 for clarity. In practice however the cover 23 is hinge mounted to the body 15 as seen in FIGS. 2, 3, and 4. The rear of the cover 23 has pivot pins 24, 25 which rotate in corresponding hollows 26, 27 provided in the body 15. A cam 28 is arranged on the pivot axis. A follower 29, which is preferably a spring formed of the same neutral piece 19 as are the neutral terminals, presses against the cam. The cam 28 is indented so that the follower 29 holds the cover 23 open during wiring procedures, such as shown in FIG. 3, and fully closed during shipping so that the cover will protect the terminals.

The cover front 30 has a slot or yoke 31 for receiving the end of the cord 14. The inner surface of the cover 23 has a groove 32 to guide the cord 14 from the cover front 30 to the cover rear 35 during cord insertion. The cover rear 35 is stepped, having a recess 36 sized to pass only one wire of the cord 14. Because of this recess 36, the end of the cord 14 must be step cut to be properly inserted. The step arrangement offers several benefits. The end of the cord must be step cut assuring electrical insulation between adjacent wires. It is anticipated that most lighting unit manufacturers will use a cord set which includes a length of cord terminated on one end by a molded plug. Industry standards call for one of the two flat prongs of the plug to be wider than the other. The wider prong is inserted into the neutral port of the AC receptacle. If the end of the cord is properly step cut, the wiring will be automatically correctly polarized with the neutral wire connected to the terminal 17 corresponding to the threaded screwshell 11. The recess on the rear cover 35 may be a through hole 36, in which case it would allow visual inspection of the wiring.

After the end of the cord 14 is inserted in cover 23, the cover is closed over the terminal end 18 of the body 15 causing the terminals 16, 17 to pierce the insulation of the corresponding wire of the cord set to make contact with the conductive strands within the wires. The cover 23 aligns the cord 14 with the terminals. Recesses 37, 38 on the inner side of the cover 23 opposite the terminals allow for clearance of pierce points. A captive screw 40 may be screwed in a threaded hole 41 securing the cover 23 closed over the end of the body 15.

The terminal end 18 of the body 15 has integral ridges 39 between the terminals and the entry of the cord. The closed cover clamps the cord against the ridges 39 which engage the insulation of the cord 14. The clamping action provides a strain relief.

As seen in FIG. 2 the electrical cord 14 is bent about the front 30 of the cover 23 allowing a paper sleeve or liner (not shown) to be slid over the assembly. A two-piece metal housing (not shown) may be snapped together over the insulating liner.

In the embodiment illustrated by FIG. 1, the body 15 contains a rotary-knob switch arranged to connect the "hot" terminal to one or more of the inner socket contacts. In this type of switch a knob 42 turns a shaft 43 supporting a four armed star rotor (not shown) within the body 15. The star rotor member itself is non-conducting but has a metal rim arranged on selected arms depending on the switching function. The star rotor ratchets with corresponding switch contacts. The hot terminal 16 may be an extension of a switch contact. This is shown in more detail in FIGS. 5, 6, and 7 which show various switch contact arrangements. The neutral terminal is electrically connected directly to the screwshell 11 in all cases.

Figure 5:
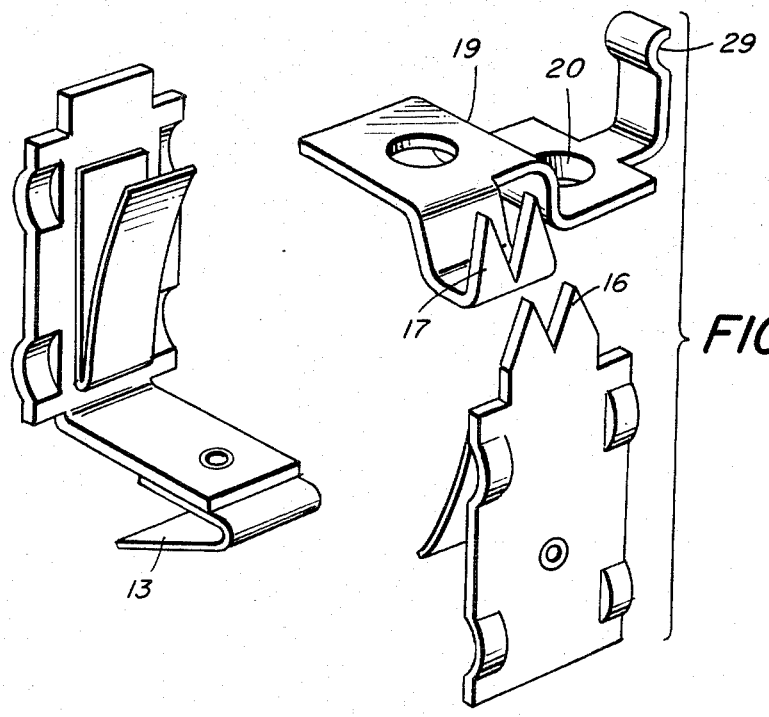
FIG. 5 illustrates terminals adapted to on-off switching.

For single lamp operation, only one pair of terminals is necessary. FIG. 5 shows a contact arrangement for one lamp, single filament applications wherein only one inner socket contact is necessary. The "hot" wire terminal 16 is switchably connected by the star wheel to the central socket contact 13 for simple on-off operation. Two opposite arms of the star rotor (not shown) have a common conductive rim.

Figure 6:
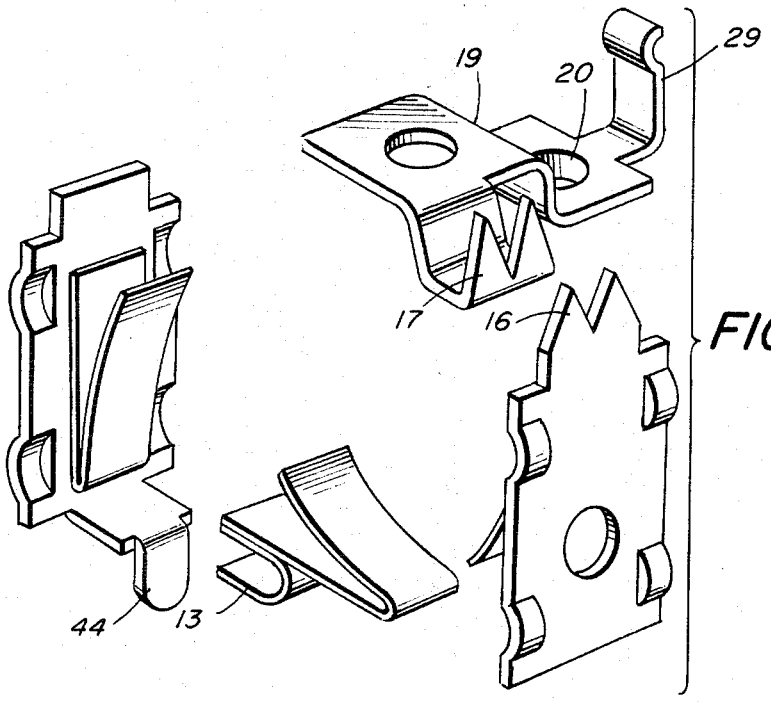
FIG. 6 illustrates terminals adapted for two filament lamp switching.

FIG. 6 shows a contact arrangement for two filament "3-way" lamp operation. The "hot" wire terminal is switachably connected by the star rotor to one or both of two inner socket contacts, a center contact 13 and an intermediate contact 44. Three arms of the star rotor (not shown) have a common conductive rim.

Figure 7:
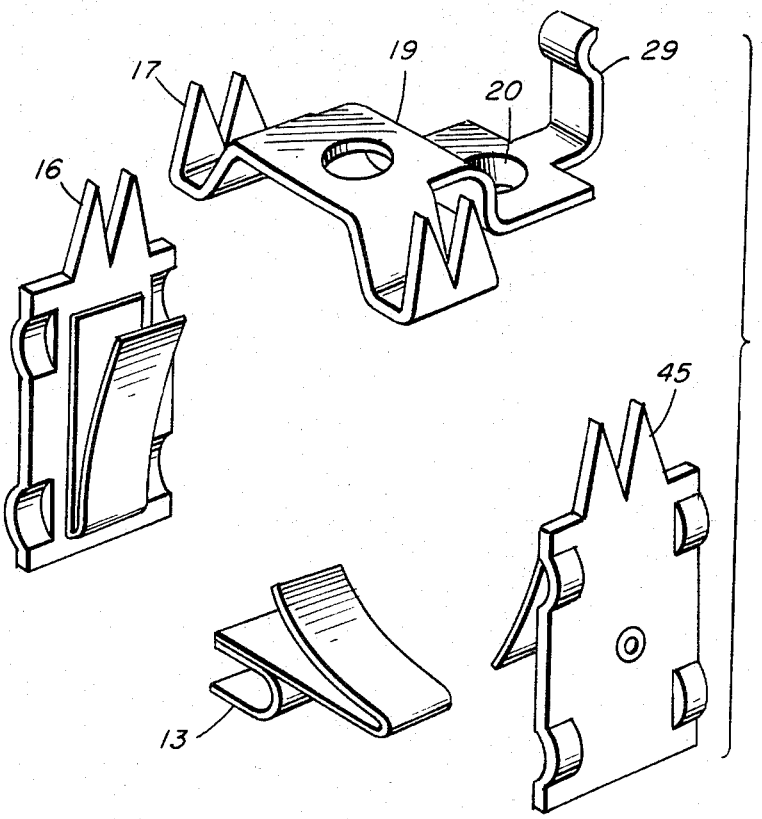
FIG. 7 illustrates terminals for three terminal switching.

Some applications call for a switchable socket assembly to control a keyless socket assembly. This is called a "three terminal socket", for which a contact arrangement is shown in FIG. 7. A second pair of terminals can be provided to interconnect socket assemblies. Both neutral terminals of the both pairs may be formed of the same neutral piece 19. The "hot" terminal 45 of the second pair is connected to another switch contact within the body. Three arms of the star rotor (not shown) have a common conductive rim.

U.S. Pat. No. 4,283,107 for "Lampholder Having Terminals of the Insulation-Displaying Type" issued to Walter Anthony describes the construction and operation of rotary knob switches having these functions.

Figure 8:
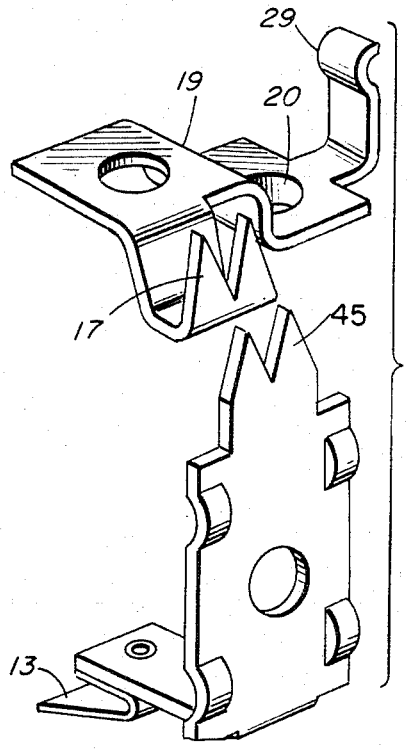
FIG. 8 illustrates terminals for keyless socket assemblies.

Alternately, the socket assembly may be "keyless", which means no switch at all. In this case the "hot" terminal 45 is permanently connected directly to the central contact 13 as shown in FIG. 8.

Thus, there have been described several embodiments of a one piece lamp socket assembly which meets the objectives of ease of assembly, no wire stripping or tinning, strain relief and one screw assembly during wiring. Features aid correct polarization of the cord set and provide visual and mechanical aids during the wiring operation.

While there has been shown and described what are at present considered the preferred embodiments of the invention, it will be obvious to those skilled in the art that various changes and modifications may be made therein without departing from the scope of the invention as defined by the appended claims.

I claim:

1. An electric lamp socket assembly for stripless connection to an electric cord having a hot wire and a neutral wire, said assembly comprised of:

a screwshell for holding an electric lamp bulb;

at least one inner contact for making electrical contact to said lamp bulb;

a body of insulating material having one end supporting said screwshell and contact;

at least one pair of insulation piercing terminals projecting from the opposite end of said body, one of said terminals for connection to said hot wire and another terminal for connection to said neutral wire; and a cover arranged in pivotable relation with said body, said cover having means to align said wires with said terminals and adapted to close over said terminals thereby clamping said cord against said body, said means requiring insertion of said wires in the direction of their lengths through an opening of the cover, and including an abutment at the other end thereof located in line with said opening and limiting the extent to which the wires may be inserted.

2. The electric lamp socket assembly of claim 1 wherein said cover has a yoke for holding said cord and a groove for aligning said cord with said terminals during wiring, said yoke having said opening formed therein and said groove extending fully from the yoke to said abutment, the groove and opening requiring that both wires be in longitudinally contacting relation when inserted through the opening and engaged by the abutment in alignment with the respective terminals.

3. An electric lamp socket assembly as in claim 1, wherein the pivotable relation of the cover to the body is disposed at one end of the cover and the cover includes means at its other end for fixedly connecting the cover to the body when in its closed position, the cover having an opening at said other end thereof through which the cord is extendable, the body including means for strain relieving the cord in an area thereof between the terminals and said opening of the cover, said body having a flat surface facing toward said cover and cooperating with the cover in clamping the wires therebetween, said terminals projecting above the flat surface so as to require that the wires will be pierced by the terminals when clamped between the cover and said flat surface, said strain-relieving means being formed upon said flat surface and also projecting thereabove to an extend requiring that said strain-relieving means be forced into the wires whenever the wires are pierced by the terminals and are clamped between the cover and body.

4. An electric lamp socket assembly as in claim 3, wherein the strain-relieving means comprises a series of ridges on the body extending transversely of the path along which the cord extends between the openings and the terminals.

5. An electric lamp socket assembly as in claim 4 wherein the ridges are integral with the body.

6. An electric lamp socket assembly for stripless connection to an electric cord having a hot wire and a neutral wire, said assembly comprised of:

a screwshell for holding an electric lamp bulb; at least one inner contact for making electrical contact to said lamp bulb;

a body of insulating material having one end supporting said screwshell and contact;

at least one pair of insulation piercing terminals projecting from the opposite end of said body, one of said terminals for connection to said hot wire and another terminal for connection to said neutral wire;

a cover arranged in pivotable relation with said body, said cover having means to align said wires with said terminals and adapted to close over said terminals thereby clamping said cord against said body;

a cam on said cover; and a spring arranged to press against said cam and hold said cover in open and closed positions.

7. The electric lamp socket assembly of claim 6 wherein one of said terminals and said spring are parts of one piece of metal.

8. The electric lamp socket assembly of claim 7 wherein said piece is electrically connected to said screwshell.

9. The electric lamp socket assembly of claim 7 which further includes a second pair of terminals, one of said second pair of terminals is part of said piece of metal.

10. The electric lamp socket assembly of claim 9 wherein said piece is electrically connected to said screwshell.

11. An electric lamp socket assembly for stripless connection to an electric cord having a hot wire and a neutral wire, said assembly comprised of:

a screwshell for holding an electric lamp bulb;

at least one inner contact for making electrical contact to said lamp bulb;

a body of insulating material having one end supporting said screwshell and contact;

at least one pair of insulation piercing terminals projecting from the opposite end of said body, one of said terminals for connection to said hot wire and another terminal for connection to said neutral wire; and a cover arranged in pivotable relation with said body, said cover having means to align said wires with said terminals and adapted to close over said terminals thereby clamping said cord against said body, said cover having a recess so that said cord must be step cut for proper insertion, thereby assuring correct polarization of the cord and electrical clearance between the wire ends.

12. The electric lamp socket assembly of claim 11 wherein said recess is a hole allowing visual check of proper cord insertion.

* * * * *